US012162525B2

(12) United States Patent
Indre et al.

(10) Patent No.: US 12,162,525 B2
(45) Date of Patent: Dec. 10, 2024

(54) METHOD AND SYSTEM FOR REGULATING GUIDED VEHICLE HEADWAYS

(71) Applicant: Siemens Mobility SAS, Chatillon (FR)

(72) Inventors: Marius Traian Indre, Verrieres-le-Buisson (FR); Thierry Bouchet, Antony (FR)

(73) Assignee: Siemens Mobility SAS, Chatillon (FR)

( * ) Notice: Subject to any disclaimer, the term of this patent is extended or adjusted under 35 U.S.C. 154(b) by 210 days.

(21) Appl. No.: 17/691,317

(22) Filed: Mar. 10, 2022

(65) Prior Publication Data

US 2022/0289260 A1 Sep. 15, 2022

(30) Foreign Application Priority Data

Mar. 10, 2021 (EP) ..... 21290015

(51) Int. Cl.
*B61L 27/37* (2022.01)
*B61L 27/10* (2022.01)
*B61L 27/40* (2022.01)

(52) U.S. Cl.
CPC ..... *B61L 27/37* (2022.01); *B61L 27/10* (2022.01); *B61L 27/40* (2022.01)

(58) Field of Classification Search
CPC ..... B61L 27/10; B61L 27/37; B61L 27/40
See application file for complete search history.

(56) References Cited

U.S. PATENT DOCUMENTS 7,006,796 B1 * 2/2006 Hofmann ..... H04W 76/22 455/66.1
7,512,481 B2 * 3/2009 Julich ..... G06Q 10/08 701/19
9,744,981 B2 * 8/2017 Niinomi ..... B61L 27/16

OTHER PUBLICATIONS

Pochet, Juliette et al: "Supervision and rescheduling of a mixed CBTC traffic on a suburban railway line"; 2016 IEEE International Conference on Intelligent Rail Transportation (ICIRT), IEEE; Aug. 23, 2016 (Aug. 23, 2016), pp. 32-38; XP032978346.
Mazzarello, Maura et al: "A traffic management system for real-time traffic optimisation in railways"; Transportation Research Part B. Methodological, Oxford, GB; vol. 41, No. 2, Feb. 1, 2007 (Feb. 1, 2007), pp. 246-274; XP005661324.

* cited by examiner

*Primary Examiner* — Adam D Tissot
(74) *Attorney, Agent, or Firm* — Laurence A. Greenberg; Werner H. Stemer; Ralph E. Locher

(57) ABSTRACT

A method and system for managing traffic of guided vehicles over a railway network include a first ATS system for regulating traffic of guided vehicles over a first regulation domain of the network and a second ATS system configured for regulating traffic of guided vehicles over a second regulation domain. The regulation domains have a common boundary and at least one track connects a first position within the first regulation domain to a second position within the second regulation domain. The second ATS system detects limited traffic capacity at the second position and automatically computes, as a function of the detected limited traffic capacity, a target headway between two successive guided vehicles crossing the common boundary for entering the second regulation domain. The first ATS system automatically determines, from the received target headway, a reference timetable, complying with the received target headway, for the first regulation domain.

15 Claims, 2 Drawing Sheets

METHOD AND SYSTEM FOR REGULATING GUIDED VEHICLE HEADWAYS

CROSS-REFERENCE TO RELATED APPLICATION

This application claims the priority, under 35 U.S.C. § 119, of European Patent Application EP 21 290 015.3, filed Mar. 10, 2021; the prior application is herewith incorporated by reference in its entirety.

FIELD AND BACKGROUND OF THE INVENTION

The present invention relates to a system and a method for regulating guided vehicle headways at a boundary of two Automatic Train Supervision (ATS) systems.

The present invention is basically related to the field of guided vehicles, wherein the expression "guided vehicle" refers to public transport systems such as subways, trains or train subunits, etc., as well as load transporting systems such as, for example, freight trains, for which safety is a very important factor and which are guided along a route or railway by at least one rail, in particular by two rails. More specifically, the present invention relates to safety aspects with respect to a railway network including such guided vehicles and focuses on the traffic of guided vehicles over the railway network.

Usually, the railway network is divided into different geographical areas, called regulation domains, each managed by an ATS system the task of which is to manage the guided vehicle traffic on its assigned regulation domain according to specific regulation criteria or rules.

A typical guided vehicle management process follows the following steps:

Step 1: before any operation of a guided vehicle on an ATS system regulation domain, the ATS system managing the regulation domain receives a nominal timetable, i.e. a theoretical timetable, defining or including, for each guided vehicle having to move within its regulation domain and for a predefined time period (typically 1 day), a nominal schedule corresponding to a nominal operation (the nominal schedule might also be called a nominal "circulation": it defines the different positions of the guided vehicle within the regulation domain as a function of the time) of the considered guided vehicle within the regulation domain and within the predefined time period, the nominal schedule defining typically an objective arrival time and an objective departure time for successive positions, e.g. stations, within the regulation domain, the successive positions defining a planned route for the guided vehicle.

Step 2: during operation of guided vehicles on its regulation domain, the ATS system continually tracks and monitors in real time guided vehicle effective operations on its regulation domain and builds a reference timetable, i.e. a real timetable by opposition to the theoretical timetable, based on the effective operations. The reference timetable represents or shows a reference schedule. The reference schedule includes a real-time schedule for each guided vehicle having moved or moving on the regulation domain of the ATS system, as well as an estimated future schedule for guided vehicles moving or going to move on the regulation domain. The real-time schedule includes typically an effective arrival time and an effective departure time for successive positions already reached by a considered guided vehicle. The estimated future schedule includes an estimated future arrival time and an estimated future departure time for successive future positions of a considered guided vehicle. In particular, the ATS system is configured for determining an estimated future schedule that takes into account an effective delay in the real-time schedule with respect to the nominal schedule. For this purpose, it is preferentially configured for automatically adding, to the objective arrival time and/or objective departure time and for all guided vehicles moving or having to move on its regulation domain within a predefined timeframe (typically 60-90 minutes), a time value determined as a function of the effective delay. For all other guided vehicles which are moving or going to move within its regulation domain but outside of the predefined timeframe, then the estimated future arrival time and/or the estimated future departure time are taken by the ATS system as equal to the objective arrival and departure time of the nominal timetable. The real-time schedule of a guided vehicle is thus based on the real operation of the guided vehicle and may differ from the nominal schedule, while the estimated future schedule is based on estimated guided vehicle operations in a near future.

For instance, and as explained in the next steps, if a tracked guided vehicle is delayed for an effective delay in respect to its nominal schedule, then its reference schedule in the reference timetable shall be adapted. In particular, the ATS system may calculate from the effective guided vehicle operations and the nominal timetable, the estimated future arrival time and departure time for a next position of a considered guided vehicle. The estimated future arrival and departure times might be shifted towards the future with a time value typically equal to the effective delay. This impacts also part or all the following guided vehicles within the predefined timeframe: their nominal schedule might have also to be shifted if the effective delay of the tracked guided vehicle leads to breaking some specific regulation criteria like temporal rules of minimal headway between consecutive guided vehicles. Therefore, within its regulation domain, the ATS is configured for rescheduling guided vehicles in real time according to information provided by traffic monitoring devices equipping its regulation domain if a response to an event, e.g. delay, requires such rescheduling.

Step 3: during operation of guided vehicles on its regulation domain, the ATS system continually compares the reference timetable to the nominal timetable in order to detect effective delays for a guided vehicle moving within its regulation domain.

Step 4: during the operation of guided vehicles on its regulation domain, the ATS system uses a set of algorithms configured for outputting an optimized timetable, the latter including typically the estimated future arrival and departure times for the guided vehicles, modifying thus the nominal timetable while satisfying specific regulation criteria. The ATS system uses the optimized timetable for creating or updating its reference timetable. Typically, before operation of any guided vehicle, e.g. at the beginning of the day, the reference timetable and the nominal timetable are identical. Then, as the day progresses, the reference timetable will diverge from the nominal timetable in real-time due to detected effective delays and their impact on future guided vehicle schedules considered within the above-mentioned predefined timeframe. The ATS system uses the algorithm with, as inputs, the nominal timetable and the most recently determined reference timetable, for periodically (e.g. every 3 firsts) outputting the optimized timetable. The optimization is preferentially always done within the predefined timeframe. The optimized timetable is then used to modify/update the most recently determined reference timetable before launching another optimization cycle. The modified/updated reference timetable is finally used by the ATS system to command interlocking and guided vehicle motion on its regulation domain.

The regulation criteria used for determining an optimized timetable are for instance:

a. Minimize delays between the optimized timetable and the nominal timetable for all guided vehicle schedules;
b. Minimize headway difference between the nominal timetable and the reference timetable for all pairs of schedules of consecutive guided vehicle travelling in the same direction on the same route;
c. Minimize energy consumption of all guided vehicles having a schedule which is defined by the optimized timetable.

The algorithms might be configured for:

a. changing run times of guided vehicles, i.e. the time required for travelling from a first position to a second position;
b. changing dwell times at stations respecting a predefined minimum dwell time for each station;
c. changing guided vehicle routes without skipping guided vehicle station stops required by the nominal schedule of the guided vehicle.

Step 5: during the operation of guided vehicles on its regulation domain, the ATS system provides a guided vehicle control system (e.g. a CBTC system), if any are available, with a changed dwell and/or run time.

Step 6: during the operation of guided vehicles on its regulation domain, the ATS system commands interlocking mechanisms to set routes according to the reference timetable.

One problem related to ATS systems is the management of guided vehicles at a boundary, hereafter called a "common boundary," shared by two directly neighboring ATS systems. Indeed, according to prior art techniques, each neighboring ATS system is configured for regulating the traffic of guided vehicles on its regulation domain only, and thus up to the common boundary, wherein the regulation depends on its regulation criteria. Consequently, each neighboring ATS system is trying to clear out guided vehicles towards and up to its boundary as quickly as possible in order to avoid delays on its regulation domain without taking into account a traffic state of each of its neighboring ATS systems.

Thus, according to prior art techniques, if a traffic issue occurs on the regulation domain of a second ATS system having a common boundary with a first ATS system, the traffic issue leading for instance to a limited guided vehicle traffic capacity on the regulation domain of the latter, then that traffic issue is not taken into account by the first ATS system which can result in traffic congestion. In order to avoid such congestions, operators of the second and first ATS systems usually communicate with each other through radio or telephone for providing information regarding traffic issues, so that appropriate measures can be manually applied within their respective regulation domain if a traffic issue occurs on the other regulation domain, so that guided vehicle traffic towards the common boundary can be limited.

SUMMARY OF THE INVENTION

It is accordingly an object of the invention to provide a method and a system for regulating guided vehicle headways, which overcome the herein aforementioned disadvantages of the heretofore-known methods and systems of this general type and which improve the management of guided vehicle traffic at a boundary of two ATS systems, notably by controlling guided vehicle headways at the boundary.

In order to achieve these objects, the present invention proposes a system and a method for managing traffic of guided vehicles within a railway network as disclosed by the independent claims. Other advantages of the invention are presented in the dependent claims.

With the foregoing and other objects in view there is provided, in accordance with the invention, a system for managing traffic of guided vehicles within a railway network, the system comprising:

a first ATS system configured for regulating the traffic of guided vehicles over a first regulation domain;

a second ATS system configured for regulating the traffic of guided vehicles over a second regulation domain different from the first regulation domain, wherein the first and the second regulation domains have a common boundary or border and wherein at least one track connects a first position located within the first regulation domain to a second position located within the second regulation domain, the first and second positions each being for instance a station position in the respective regulation domains, or simply a position wherein two tracks connect with each other in order to form a single track;

the second ATS system is configured for detecting a limited guided vehicle traffic capacity at the second position and for automatically computing, as a function of the detected limited guided vehicle traffic capacity, a target headway to be applied by the first ATS system between two successive guided vehicles having to cross, notably within a predetermined timeframe (this predetermined timeframe is a period of time automatically determined by the second ATS system, and which provides for instance an estimation of the period of time required for overcoming the traffic capacity limitation, or which is chosen by the second ATS system as a function of a type of traffic capacity limitation, or alternately, the predetermined timeframe might be provided as an input by an operator), the common boundary for entering the second regulation domain, the target headway being preferentially defined at the common boundary. For instance, a target headway might be computed for each couple of two directly successive guided vehicles having to cross the common boundary within the predetermined timeframe for entering the second regulation domain. The second ATS system is further configured for automatically sending the target headway(s) to the first ATS system;

the first ATS system is configured for automatically determining from the received target headway(s), for instance from the target headways received for all couples of two directly successive guided vehicles having to cross the common boundary within the predetermined timeframe, a reference timetable for the first regulation domain, wherein the reference timetable satisfies/respects the received target headway(s). In other words, the first ATS system is configured for determining a reference timetable which matches the target headway defined, notably at the common boundary, by the second ATS system, for two successive guided vehicles having to cross the common boundary for entering the second regulation domain from the first regulation domain. For instance, the same target headway might be defined by the second ATS system for all couples of directly successive guided vehicles having to cross the common boundary within the predetermined timeframe, the same target headway being then used by the first ATS system for determining a reference timetable that complies with the received "same" target headway. A reference timetable computed at a time Ti by an ATS system defines schedules for guided vehicles having to move on its regulation domain, wherein the schedules included in the reference timetable for T<Ti are real schedules that have been verified by the guided vehicle displacements on the regulation domain and schedules included in the reference table for T≥Ti are estimated future schedules, taking account, according to the present invention, of the target headway received by the ATS system if any has been received.

With the objects of the invention in view, there is also provided a method for managing traffic of guided vehicles over a railway network, the method comprising:

detecting, by a second ATS system, a limited guided vehicle traffic capacity at a second position, wherein the second ATS system is configured for regulating the traffic of guided vehicles over a second regulation domain;

automatically computing, by the second ATS system and as a function of the detected limited guided vehicle traffic capacity, a target headway to be applied between two directly successive guided vehicles having to cross, notably within a predetermined timeframe, a common boundary for entering the second regulation domain, the target headway being preferentially defined at the common boundary, i.e. defining the time interval that shall separate a first guided vehicle from a second guided vehicle that directly follows the first guided vehicle when the second guided vehicle crosses the common boundary. In particular, such a target headway might be defined for each couple of directly successive guided vehicles having to cross the common boundary within the predetermined timeframe (i.e. the second ATS system computes for each couple of guided vehicles a "specific" target headway, e.g. as a function of the planned schedule for the guided vehicles, and/or as a function of their type (e.g. fast guided vehicle, slow guided vehicle, etc.), or the same target headway might be defined for all couples of directly successive guided vehicles having to cross the common boundary within the predetermined timeframe (in this case, the planned schedules of the guided vehicles is taken into account by the second ATS system for computing a "global" target headway that is the same for the all couples of directly successive guided vehicles);

automatically sending, by the second ATS system and to a first ATS system, the target headway, for instance the same target headway computed for all couples of directly successive guided vehicles having to cross the common boundary within the predetermined timeframe, or the "specific" target headway computed for each couple of directly successive guided vehicles having to cross the common boundary within the predetermined timeframe, the first ATS system being configured for regulating the traffic of guided vehicles over a first regulation domain different from the second regulation domain, wherein the second and the first regulation domains share the common boundary or border and wherein at least one track connects the second position located within the second regulation domain to a first position located within the first regulation domain, the guided vehicles typically moving from the first position to the second position for entering the second regulation domain;

receiving, by the first ATS system, the target headway(s) and automatically determining from the received target headway(s) a reference timetable for the first regulation domain, wherein the reference timetable complies with the target headway defined by the second ATS system for the directly successive guided vehicles, for instance defined for each or all of the couples of directly successive guided vehicles, having to cross the common boundary, notably within the predetermined timeframe, for entering the second regulation domain. Advantageously, the first ATS system then manages the traffic on its regulation domain according to the determined reference timetable which is configured for limiting or minimizing a traffic congestion on the second regulation domain, since it is based on the target headway(s) calculated by the second ATS system as a function of its current limited traffic capacity.

The target headway is configured for defining, for a guided vehicle, a distance, temporal or spatial, that shall separate the guided vehicle from a directly previous guided vehicle (i.e. the guided vehicle and the previous guided vehicle are two directly successive guided vehicles moving on the same track and according to the same direction, e.g. moving from the first position to the second position) when the guided vehicle crosses the common boundary for entering the second regulation domain, i.e. when it enters the second regulation domain. According to the present invention, the target headway is thus imposed by the second ATS system to the first ATS system even if the target headway does not satisfy the regulation criteria of the first ATS system. The reference timetable determined by the first ATS system complies thus with the received target headway(s) and is the best attempt of the first ATS system to satisfy a maximum number of its regulation criteria while complying with the received target headway(s).

For this purpose, and preferentially, the first ATS system includes at least one algorithm configured for regulating and optimizing the traffic flow on its regulation domain and that takes into account the target headway(s). The algorithm is used by the first ATS system for calculating, for the predefined timeframe, the optimized timetable. The received target headway is used by the algorithm as an imposed constraint that shall be satisfied when computing the optimized timetable. Preferentially, the predefined timeframe is taken equal to the predetermined timeframe that might be provided by the second ATS system to the first ATS system, e.g. together with the target headway value, and preferentially, for each target headway value that is computed and sent to the first ATS system. The inputs of the algorithm include at least the regulation criteria of the first ATS system, its nominal timetable, its most recently determined reference timetable, and the received target headway(s). Optionally, the inputs to the algorithm may also include configuration and circulation data characterizing the first regulation domain. The first ATS system is configured for using the target headway(s) as fixed/imposed parameter(s) within its algorithm and to determine, by using the algorithm, the optimized timetable that satisfies a maximum number of its regulation criteria, while satisfying the imposed target headway(s). The first ATS system uses then the optimized timetable to determine ("determine" may include update, modify, or calculate) its reference timetable, which is then used for controlling the interlocking mechanisms within its regulation domain. Preferentially, the second ATS system uses a target headway algorithm for computing the target headway, wherein the target headway algorithm uses as inputs at least the regulation criteria of the second ATS system, its nominal timetable, its most recently determined reference timetable, and configuration and circulation data that define notably the current traffic capacity, and therefore the currently occurring traffic capacity limitation. Alternately, the second ATS system may include a database storing one or several values of target headways, wherein each value corresponds to a predefined level of congestion, i.e. of traffic capacity limitation, that might be determined by the second ATS system from measured guided vehicles delays.

Configuration and circulation data according to the invention may typically include, for each guided vehicle, at least one of the following data:

- the schedule planned for the guided vehicle in the nominal timetable;
- the schedule planned for the guided vehicle in the reference timetable. The reference timetable is configured for indicating a delay if any;
- a temporal constraint issued by an operator command and applying to the guided vehicle;
- a minimum headway value between the considered guided vehicle and another guided vehicle directly preceding or following the considered guided vehicle in the first regulation domain.

The present invention proposes to thus detect an issue that may impact the traffic of guided vehicles on the second regulation domain, to compute target headways for successive guided vehicles having to cross the common boundary and enter the second regulation domain, wherein applying the target headway would result in an acceptable train traffic capacity for the second regulation domain taking into account the issue, the first ATS system being then configured for taking into account the received target headway(s), and thus the limited guided vehicle traffic capacity within the second regulation domain while trying to adhere to its regulation criteria.

Other features which are considered as characteristic for the invention are set forth in the appended claims.

Although the invention is illustrated and described herein as embodied in a method and a system for regulating guided vehicle headways, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
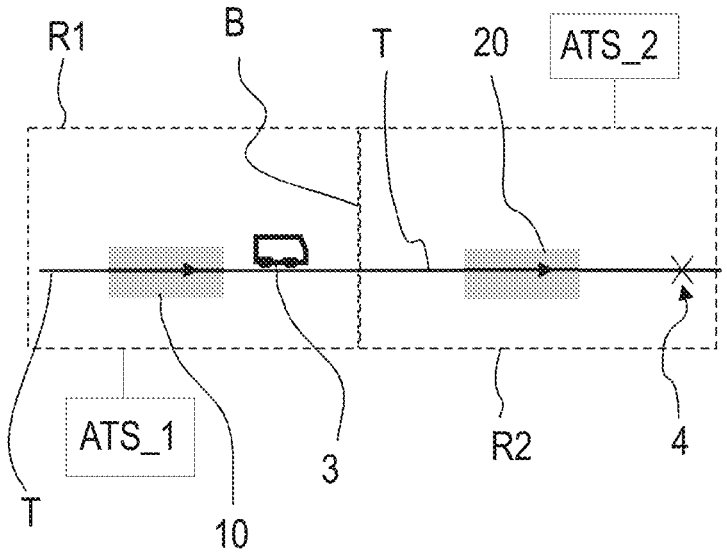
FIG. 1 is a schematic representation of a preferred embodiment according to the invention.

Referring now to the figures of the drawings in detail and first, particularly, to FIG. 1 thereof, there is seen a schematically illustrated portion of a railway network divided in geographical areas corresponding to regulation domains and in which the guided vehicle traffic or flow on each regulation domain is managed by an ATS system. More particularly, FIG. 1 shows a first regulation domain R1 managed by a first ATS system ATS_1 and a second regulation domain R2 managed by a second ATS system ATS_2. The first regulation domain R1 and the second regulation domain R2 share a common boundary B.

A track T connects a first position within the first regulation domain R1, for instance the position of a first station 10, to a second position located within the second regulation domain R2, for instance the position of a second station 20. Guided vehicles 3 are moving from the first position (upstream) to the second position (downstream) and thus have to cross the common boundary B when moving from the first regulation domain R1 to the second regulation domain R2.

An ATS system according to the invention, e.g. the first or second ATS system ATS_1, ATS_2, includes a processor, a memory, and communication devices. The memory, or an external database of the ATS system, may include a set of traffic regulation criteria, a nominal timetable, a reference timetable based on the nominal timetable, and one or several algorithms based on the traffic regulation criteria, and optionally one or several predefined values of target headways. The ATS system is configured for applying the one or several algorithms to acquired or received traffic data (typically circulation and configuration data) for continuously or periodically updating its reference timetable and determining regulation data that are then applied to devices located within its regulation domain, e.g. interlocking mechanisms, for controlling the guided vehicle traffic over its regulation domain.

Figure 2:
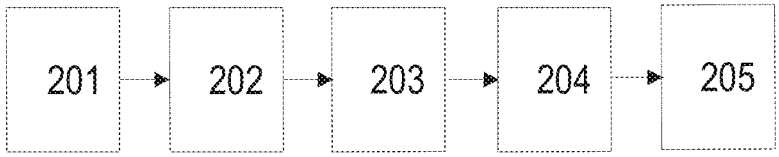
FIG. 2 is a flowchart of a preferred method according to the invention.

FIG. 2 schematically illustrates the method according to the invention for managing the traffic of guided vehicles moving from the first regulation domain R1 to the second regulation domain R2 as illustrated by FIG. 1.

At step 201, the second ATS system ATS_2, i.e. the downstream ATS system, detects an issue 4 that may lead to a limited guided vehicle traffic capacity on its regulation domain, notably at the second position.

For this purpose and preferentially, the second ATS system ATS_2 is configured for automatically estimating, for a specific number TC of successive guided vehicles, the delay of each of the successive guided vehicles when passing or crossing the second point, wherein each of the delays is measured with respect to the nominal timetable of the second ATS system ATS_2. The delays which have been measured thus form a set of delays.

Preferentially, the second position is a point on the railway network of the second regulation domain R2 wherein a limitation of the traffic capacity would lead to a maximum congestion of guided vehicles within the second regulation domain or would have the most severe consequences, notably with respect to guided vehicle delays within the second regulation domain R2. Such a point is for instance a junction.

In particular, the specific number TC of successive guided vehicles having a respective delay which is tracked by the second ATS system ATS_2 is greater or equal to 3. This specific number is preferentially automatically determined by the second ATS system ATS_2 as a function of:

- a duration of one or several peak hours and of one or several off-peak hours at the second position;
- a nominal headway defined for each couple of directly successive guided vehicles having to cross the second position during a peak hour;

the predefined timeframe, i.e. the value of the period of time for which the optimized timetable is computed.

Figure 3:
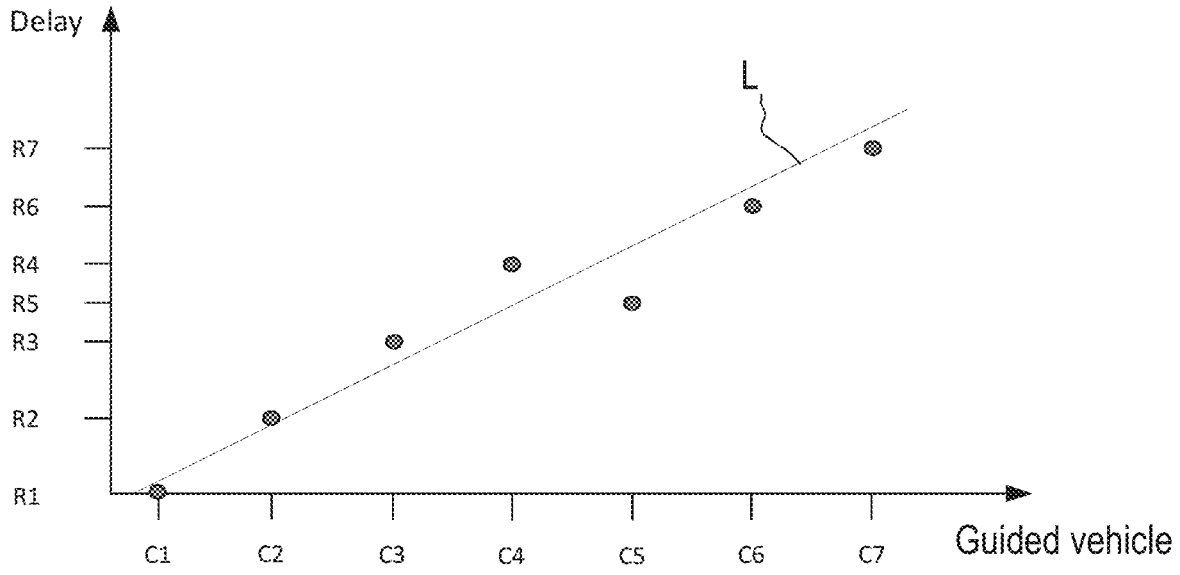
FIG. 3 is a graphical illustration of tracked delays for successive guided vehicles.

FIG. 3 illustrates the respective delays R1-R7 measured by the second ATS system ATS_2 for 7 successive guided vehicles C1 to C7, each delay Ri, i=1 to 7, indicating the delay of the guided vehicle Ci at the second position with respect to the nominal timetable, i.e. with respect to the time at which it should have crossed or passed the second position according to its nominal schedule.

Preferentially, the second ATS system ATS_2 is configured for using a regression analysis for determining whether the successive guided vehicle delays that have been measured will lead to a limited traffic capacity (i.e. a traffic saturation) at the second position. For instance, the second ATS system ATS_2 includes a traffic saturation estimation algorithm configured for applying a least squares method to the set of measured delays, using for instance a linear fit for fitting the set of measured delays, wherein the slope or gradient G of the resulting line L that fits the measured delays is used by the second ATS system ATS_2 for determining whether a limited traffic capacity will occur or not. In particular, a limited traffic capacity is detected at the second position of the second regulation domain R2 if the slope or gradient of the line L resulting from the application of the least squares method to the set of delays is greater than a predetermined gradient threshold (hereafter "GT") value, otherwise no limited traffic capacity (i.e. no traffic saturation) is detected at the second position by the second ATS system ATS_2. Preferentially, the second ATS system ATS_2 includes, e.g. in its memory or in a database, a predetermined GT value defined for each specific number TC that might be used for the regression analysis. The values stored in the system according to the invention for each couple (TC, GT) will directly influence the performance of the limited traffic capacity detection.

Preferentially, the second ATS system ATS_2 includes a set of n traffic saturation estimation algorithms A1, . . . , An, wherein the A1 to An traffic saturation estimation algorithms are configured for running in parallel in order to detect a limited traffic capacity at the second position. Each traffic saturation estimation algorithm Ai, i=1, . . . , n, is configured for tracking the delays of a given number TCi of guided vehicles, which is different for each of the traffic saturation estimation algorithms. For each traffic saturation estimation algorithm Ai, a given predetermined gradient threshold GTi is defined and used by the second ATS system for determining whether there is or not traffic saturation at the second position. Therefore, a couple (TCi,GTi) is defined for each traffic saturation estimation algorithm Ai, wherein each couple (TCi,GTi) is predefined in a memory or database of the system according to the invention. A severity Si is associated to each couple (TCi,GTi), wherein the severity Si represents a degree or level of traffic congestion, wherein the severities Si are classified according to an increasing level of traffic congestion with S1<S2< . . . <Sn, wherein S1 represents the lowest level of traffic congestion and Sn the highest level of traffic congestion.

According to this embodiment, and for instance, A1 tracks the delays for TC1=4 successive guided vehicles, A2 tracks the delays for TC2=6 successive guided vehicles, and A3 tracks the delays for TC3=10 successive guided vehicles. Each of the traffic saturation estimation algorithms A1-A3 proceeds to a fit, by using the regression analysis, of the set of measured delays as shown in FIG. 3, obtaining therefore a line L1 for A1, a line L2 for A2 and a line L3 for A3. As previously explained, each traffic saturation estimation algorithm Ai compares then the slope of the line Li to the predetermined gradient threshold GTi associated with the given number TCi in order to determine whether the value of the slope is greater than the predetermined gradient threshold GTi value or not. If yes, then a congestion occurs, the severity of which is given by the value Si; otherwise, no congestion is detected.

At step 202, if a limited traffic capacity has been detected by the second ATS system ATS_2, then the latter automatically computes a target headway defined for each couple of successive guided vehicles that are going to enter its regulation domain according to its reference timetable, the target headway being determined as a function of the detected limited guided vehicle traffic capacity, for guided vehicles having to enter the second regulation domain within a predetermined timeframe, and defined preferentially at the common boundary B, i.e. defined for a position of a second guided vehicle located at the common boundary (wherein the second guided vehicle follows directly a first guided vehicle, wherein the target headway has been defined for the couple formed by the first and second guided vehicle), otherwise the, defined for the entering guided vehicle. In particular, the second ATS system ATS_2 computes a single target headway for all couples of directly successive guided vehicles having to cross the common boundary B within the predetermined timeframe. Alternatively, the second ATS system ATS_2 computes for each couple of directly successive guided vehicles having to cross the common boundary B within the predetermined timeframe a specific target headway (several couples of directly successive guided vehicles might have thus a different specific target).

For instance, when the slope or gradient obtained by running the traffic saturation estimation algorithm is greater than the predetermined GT value defined for the traffic saturation estimation algorithm, then the second ATS system ATS_2 automatically selects a predetermined value for the target headway. The value might be predetermined as a function of the slope or gradient, e.g. increasing with an increasing slope or gradient. If the slope or gradient obtained by running the traffic saturation estimation algorithm is smaller or equal to the predetermined GT value, then no limited traffic capacity is detected and the target headway value is not computed.

In the case of the second ATS system ATS_2 including a set of n traffic saturation estimation algorithms A1, . . . , An, running in parallel, then the downstream ATS system ATS_2 preferentially includes a plurality of predetermined target headway values TH1 to THn, wherein for each severity Si, one predetermined target headway value THi is associated, wherein the value of the predetermined target headway increases with increasing severities, i.e. T1<T2< . . . <Tn. When multiple congestions are detected at approximately the same time by running in parallel the n traffic saturation estimation algorithms, then the second ATS system ATS_2 automatically determines which severity Si among the severities associated to the detected multiple congestions represents the highest level of congestion, and then automatically selects the predetermined target headway value THi defined for the severity Si indicating the highest level of congestion. If no congestion is detected, then no predetermined target value is selected, and traffic regulation is handled according to the usual way for both the first and second ATS systems, i.e. free of a communication by the second ATS system of the predetermined target value to the first ATS system.

For instance, in the case of the traffic saturation estimation algorithm A1, A2 and A3, the second ATS system ATS_2 might have obtained, through the algorithm A1, that the slope of the line L1 is greater than the predetermined gradient threshold GT1, through the algorithm A2, that the slope of the line L2 is smaller than the predetermined gradient threshold GT2, and through the algorithm A3, that the slope of the line L3 is greater that the predetermined gradient threshold GT3. It means that two congestions are detected by the second ATS system ATS_2, one through the algorithm A1 and another one through the algorithm A3. Then the second ATS system determines which is the severity Si associated to the couple (TCi,GTi) that represents the highest level of congestion, and will select the predetermined target headway THi associated to the severity Si. In the present case, the couples (TCi,GTi) have been predetermined so that the severity S3>S1, and therefore, the second ATS system ATS_2 will automatically select the predetermined target headway TH3 for sending the latter to the first ATS system.

At step 203, the second ATS system ATS_2 automatically sends or communicates to the first ATS system ATS_1 the target headway(s) (i.e. the target headway value(s), e.g. the value of the predetermined target headway previously selected). In particular, if the second ATS system ATS_2 detects an end of the limitation of the traffic capacity, because for instance, the issue has been resolved, or the slope or gradient becomes smaller or equal to the predetermined GT value, then the second ATS system ATS_2 is configured for sending a signal configured for cancelling the target headway.

At step 204, the first ATS system ATS_1 receives the target headway(s) and automatically determines from the latter a reference timetable for the first regulation domain. According to the present invention, the reference timetable is configured for implementing a headway regulation complying, at the common boundary, with the target headway determined and sent by the second ATS system ATS_2, notably for all couples of directly successive guided vehicles having to cross the common boundary within the predetermined timeframe. According to the present invention, achieving this target headway value defined between successive guided vehicles crossing the common boundary B has priority over all other regulation criteria of the first ATS system when determining the reference timetable. Thus, the first ATS system ATS_1 will do a best effort to adhere to the target headway value that has been received and thus assigned when determining its reference timetable, notably at least until the signal configured for cancelling the target headway is received. Indeed, at the reception of the signal configured for cancelling the target headway value, the first ATS system ATS_1 automatically stops taking into account the target headway(s) for calculating its reference timetable.

Optionally, the first ATS system ATS_1 might be configured for receiving a target headway value defined by an operator and received as input in its algorithm, notably in case of a detection of the issue by the operator or a control center. When a target headway value is defined by the operator and received as input, then the value is configured for superseding any target headway value transmitted by the second ATS system ATS_2.

In conclusion, the present invention proposes a system and a method that considerably reduce the workload of operators of ATS systems, notably in stressing situations when incidents impacting train traffic capacity occur. In particular, the present invention proposes to use traffic saturation estimation algorithms that enable to detect different levels of limitations of the traffic capacity and to link each of the levels to a predetermined target headway value defined between successive guided vehicles at the common boundary. According to the present invention, headway regulation at a common boundary of an upstream ATS system might be imposed, by using the target headway value, by a downstream ATS system that detects a limitation of guided vehicle traffic within its regulation domain.

The invention claimed is:

1. A system for managing traffic of guided vehicles within a railway network, the system comprising:

a first ATS system configured for regulating the traffic of the guided vehicles over a first regulation domain of the railway network;

a second ATS system configured for regulating the traffic of the guided vehicles over a second regulation domain;

the first and second regulation domains having a common boundary and at least one track connecting a first position located within the first regulation domain to a second position located within the second regulation domain;

said second ATS system configured for detecting a limited traffic capacity at the second position and for automatically computing, as a function of the detected limited traffic capacity, a target headway to be applied by said first ATS system between two successive guided vehicles having to cross the common boundary for entering the second regulation domain, and for automatically sending said target headway to said first ATS system; and said first ATS system configured for automatically determining, from said received target headway, a reference timetable for the first regulation domain, said reference timetable satisfying said received target headway.

2. The system according to claim 1, wherein said target headway is determined for all couples of two successive guided vehicles having to cross the common boundary within a predetermined timeframe.

3. The system according to claim 1, wherein said second ATS system is configured for automatically measuring, for a specific number of successive guided vehicles, a delay, with respect to a nominal timetable, of each of the successive guided vehicles when passing or crossing the second position.

4. The system according to claim 3, wherein said specific number is greater than or equal to 3 and is automatically determined by said second ATS system as a function of:

a duration of one or several peak hours and of one or several off-peak hours at the second position;

a nominal headway defined for each guided vehicle crossing the second position during a peak hour;

a predefined timeframe.

5. The system according to claim 3, wherein said second ATS system is configured for using a regression analysis for determining whether successive guided vehicle delays lead to a limited traffic capacity at the second position.

6. The system according to claim 5, wherein said second ATS system includes a traffic saturation estimation algorithm configured for applying a least squares method using a linear fit for fitting a set of measured delays, and a slope or gradient of a resulting line fitting the measured delays is used by said second ATS system for determining whether or not a limited traffic capacity will occur.

7. The system according to claim 6, wherein a value of said target headway is predetermined as a function of said slope or gradient.

8. The system according to claim 1, wherein a target headway value defined by an operator and received as an input by said first ATS system is configured for superseding any target headway value transmitted by said second ATS system.

9. A method for managing traffic of guided vehicles over a railway network, the method comprising:

providing a first ATS system for regulating the traffic of the guided vehicles over a first regulation domain;

providing a second ATS system for regulating the traffic of the guided vehicles over a second regulation domain;

the first and second regulation domains sharing a common boundary and at least one track connecting a first position located within the first regulation domain to a second position located within the second regulation domain;

using the second ATS system to detect a limited traffic capacity at a second position;

using the second ATS system to automatically compute as a function of the detected limited traffic capacity, a target headway for a couple of successive guided vehicles having to cross the common boundary for entering the second regulation domain;

using the second ATS system to automatically send the target headway to the first ATS system; and using the first ATS system to receive the target headway and to automatically determine from the received target headway a reference timetable for the first regulation domain, the reference timetable complying with the target headway defined by the second ATS system.

10. The method according to claim 9, which further comprises determining the target headway for all couples of successive guided vehicles having to cross the common boundary within a predetermined timeframe.

11. The method according to claim 9, which further comprises carrying out the detecting step by automatically measuring, for a specific number of successive guided vehicles, a delay, with respect to a nominal timetable, of each of the successive guided vehicles when passing or crossing the second position.

12. The method according to claim 11, which further comprises using the second ATS system to automatically determine the specific number as a function of:

a duration of one or several peak hours and a duration of one or several off-peak hours at the second position;

a nominal headway defined for each guided vehicle crossing the second position during a peak hour;

a predefined timeframe.

13. The method according to claim 11, which further comprises using a regression analysis for determining whether successive guided vehicle delays lead to a limited traffic capacity at the second position.

14. The method according to claim 13, which further comprises using a traffic saturation estimation algorithm configured for applying a least squares method using a linear fit for fitting a set of measured delays, and using the second ATS system to utilize a slope or gradient of a resulting line fitting the measured delays for determining whether or not a limited traffic capacity will occur.

15. The method according to claim 14, which further comprises predetermining a value of the target headway as a function of the slope or gradient.

* * * * *